US005951270A

United States Patent [19]

DuMoulin et al.

[11] Patent Number: 5,951,270

[45] Date of Patent: Sep. 14, 1999

[54] NON-CONTIGUOUS THRUST BEARING INTERFACE FOR A SCROLL COMPRESSOR

[75] Inventors: Terrence R. DuMoulin, Monroe; Brian J. Gram, Dundee, both of Mich.

[73] Assignee: Tecumseh Products Company, Tecumseh, Mich.

[21] Appl. No.: 08/868,422

[22] Filed: Jun. 3, 1997

[51] Int. Cl.[6] ..... F04C 18/04

[52] U.S. Cl. ..... 418/55.2; 418/55.5; 418/57

[58] Field of Search ..... 418/55.1, 55.2, 418/55.5, 57

[56] References Cited

U.S. PATENT DOCUMENTS

| | | | |
|---|---|---|---|
| 4,160,629 | 7/1979 | Hidden et al. | 418/55.3 |
| 4,259,043 | 3/1981 | Hidden et al. | 418/55.3 |
| 4,300,875 | 11/1981 | Fischer et al. | 418/57 |
| 4,350,479 | 9/1982 | Tojo et al. | 418/55.5 |
| 4,435,137 | 3/1984 | Terauchi | 418/55.5 |
| 4,715,733 | 12/1987 | Rood | 384/455 |
| 4,767,293 | 8/1988 | Caillat et al. | 418/55.5 |
| 4,877,382 | 10/1989 | Caillat et al. | 418/55.5 |
| 4,950,135 | 8/1990 | Tojo et al. | 417/410 |
| 4,992,033 | 2/1991 | Caillat et al. | 418/55.3 |
| 5,131,828 | 7/1992 | Richardson, Jr. et al. | 418/55.5 |
| 5,192,202 | 3/1993 | Lee | 418/55.5 |
| 5,249,940 | 10/1993 | Matsuda et al. | 418/55.5 |
| 5,295,813 | 3/1994 | Caillat et al. | 418/55.5 |
| 5,383,772 | 1/1995 | Richardson, Jr. et al. | 418/55.6 |
| 5,419,690 | 5/1995 | Goto et al. | 418/55.1 |
| 5,447,418 | 9/1995 | Takeda et al. | 418/55.2 |
| 5,616,015 | 4/1997 | Liepert | 418/55.2 |

FOREIGN PATENT DOCUMENTS

| | | | |
|---|---|---|---|
| 55-72680 | 3/1980 | Japan | 418/55.2 |
| 59-58188 | 4/1984 | Japan | 418/55.3 |
| 60-178901 | 9/1985 | Japan | 418/55.3 |
| 61-38187 | 2/1986 | Japan | 418/55.2 |
| 61-58992 | 3/1986 | Japan | 418/55.2 |
| 61-258989 | 11/1986 | Japan | 418/55.1 |
| 62-199987 | 9/1987 | Japan | 418/55.1 |
| 63-1787 | 1/1988 | Japan | 418/55.5 |
| 1-147180 | 6/1989 | Japan | 418/55.1 |
| 2-146284 | 6/1990 | Japan | 418/55.1 |
| 2-161190 | 6/1990 | Japan | 418/55.1 |
| 2-245487 | 10/1990 | Japan | 418/55.5 |
| 2-298686 | 12/1990 | Japan | 418/55.2 |
| 3-88983 | 4/1991 | Japan | 418/55.4 |
| 3-237283 | 10/1991 | Japan | 418/55.5 |

*Primary Examiner*—John J. Vrablik
*Attorney, Agent, or Firm*—Baker & Daniels

[57] ABSTRACT

A scroll compressor having a thrust bearing interface between a fixed and orbiting scroll member. The scroll members are axially biased together by an axial compliance mechanism and the thrust bearing interface transfers axial forces between the two scroll members. The thrust bearing interface is disposed radially exterior to the wrap elements of the two scroll members and includes non-contiguous thrust bearing elements separated by void spaces located therebetween. Alternative embodiments of the thrust bearing elements include arcuate thrust bearing pads and roller bearings. The thrust bearing pads may include a channel disposed radially exterior to the pads which interconnects the void spaces. The roller bearings are separated by voids and disposed in recesses in outer perimeter portions of the fixed and orbiting scrolls. The voids, channel and recesses promote the distribution of lubricating oil to bearing surfaces of the thrust bearing interface.

11 Claims, 4 Drawing Sheets

NON-CONTIGUOUS THRUST BEARING INTERFACE FOR A SCROLL COMPRESSOR

BACKGROUND OF THE INVENTION

1. Field of the Invention

The present invention relates generally to scroll compressors which include fixed and orbiting scroll members and, more particularly, to thrust bearing interfaces located between the fixed and orbiting scroll members.

2. Description of the Related Art

A typical scroll compressor comprises two facing scroll members, each having an involute wrap wherein the respective wraps interfit to define a plurality of closed compression pockets. When one of the scroll members is orbited relative to the other member, the pockets decrease in volume as they travel between a radially outer suction port and a radially inner discharge port. The pockets thereby convey and compress a fluid, typically a refrigerant, contained therein.

During compressor operation, the pressure of the compressed refrigerant tends to force the scroll members axially apart. Axial separation of the scroll members causes the closed pockets to leak at the interface between the wrap tips of one scroll member and the face of the other scroll member. Such leakage reduces the operating efficiency of the compressor and, in extreme cases, may result in the inability of the compressor to operate.

Undesirable leakage at the tip-to-face interface between scroll members can also be caused by a tilting or wobbling motion of the orbiting scroll member. This tilting motion is the result of overturning moments generated by forces acting on the orbiting scroll which are not symmetrical about the axis of the orbiting scroll. More specifically, the drive force imparted by the crankshaft to the drive hub of the orbiting scroll is spaced axially from forces acting on the scroll wrap due to pressure, inertia and friction. The overturning moment acting on the orbiting scroll member tends to cause it to orbit in a slightly tilted condition so that the lower surface of the plate portion of the orbiting scroll is inclined upwardly in the direction of the orbiting motion. Wobbling motion of the orbiting scroll may also result from the interaction between convex mating surfaces, particularly during the initial run-in period of the compressor. For instance, the mating wrap tip surface of one scroll member and face plate of the other scroll member may respectively exhibit convex shapes due to machining variations or pressure and heat distortion during compressor operation. This creates a contact point between the scroll members, about which the orbiting scroll has a tendency to wobble, until the parts wear in. The wobbling perturbation occurs in addition to the tilted orbiting motion described above.

Efforts to counteract the separating force applied to the scroll members during compressor operation, and thereby minimize the aforementioned leakage, have resulted in the development of a variety of axial compliance mechanisms. For example, it is known to axially preload the scroll members toward each other with a force sufficient to resist the dynamic separating force. One approach is to assure close manufacturing tolerances for the component parts and have a thrust bearing interface between the fixed and orbiting scroll members for conveying axial forces between the members.

Typically, the axial compliance forces bias the tips of the scroll compressor wraps against the inner surface of the opposite scroll and/or may bias sliding surfaces on the outer perimeter of the two scroll members into mutual engagement. Frictional forces are created at these areas of contact as the moveable scroll is orbited about the fixed scroll. Excessive frictional forces generated by the axial compliance mechanism can increase the power required to operate the scroll compressor and have an abrasive effect on the engagement surfaces. The abrasive effects created by the axial compliance forces can damage or lead to excessive wearing of the wrap tips and interior surfaces, or faces, of the two scrolls when the axial compliance forces are borne by these surfaces and thereby negatively impact the sealing ability and longevity of the wrap tips.

Some prior art scroll compressors have utilized reinforcing inserts to provide enhanced resistance to wear. For example, it is known to use wear resistant inserts on the face of the scrolls for bearing against the wrap tips, it is also known to use embedded metallic inserts on sliding surfaces disposed radially exterior to the scroll wraps in plastic scroll members to enhance the wear resistance of the plastic scroll members.

SUMMARY OF THE INVENTION

The present invention provides an improved thrust bearing interface for the sliding surfaces of the scroll members which is disposed radially exterior to the scroll wraps, reduces frictional power losses, and maintains the tips and interior surfaces of the fixed and orbiting scrolls at fixed relative axial positions.

The present invention provides a scroll-type compressor including a fixed scroll member and an orbiting scroll member that are biased towards one another by an axial compliance mechanism. The axial compliance forces are transferred between the fixed and orbiting scroll by means of non-contiguous thrust bearing elements disposed radially outwardly of the scroll wraps.

In one embodiment the non-contiguous thrust bearing interface includes spaced, arcuate pads projecting from one of the scroll members and bearing either directly upon the other scroll member or upon a wear resistant annular ring disposed on the other scroll. The arcuate pads may also have an overlay of wear resistant material which may have a reduced coefficient of friction.

In an alternative embodiment, the non-contiguous thrust bearing interface utilizes grooves disposed on each scroll member. Wear resistant inserts are placed within the grooves and spaced roller bearings are disposed within the grooves in contact with the inserts and transmit axial compliance forces between the scroll members.

An advantage of a scroll compressor embodying the present invention is that the non-contiguous thrust bearing interface, in combination with an axial compliance mechanism, maintains the orbiting scroll in an axially fixed relationship to the orbiting scroll to thereby reduce the wobble and tilt of the orbiting scroll and exert a stabilizing effect on the motion of the orbiting scroll.

Another advantage of the present invention is that by utilizing the non-contiguous thrust bearing interface to bear the axial compliance forces, the wrap tips do not bear the axial compliance forces, or bear only a small fraction thereof, and can be held at a fixed position relative to the opposite scroll surface. The wrap tips are thereby subjected to less wear.

Another advantage of the present invention is that the non-contiguous nature of the thrust bearing interface facilitates the passage of oil and fluid in, around and through the thrust bearing interface. The increased oil flow provides for enhanced lubrication and thereby reduces power losses created by frictional forces and reduces wearing of the thrust bearing interface.

Yet another advantage of the scroll compressor of the present invention is that the use of high strength overlays in the non-contiguous thrust bearing interface enhances the durability of the scroll members. The utilization of wear resistant materials having a reduced coefficient of friction on the sliding surfaces of the thrust bearing interface also further reduces the power losses due to frictional forces.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein.

Figure 1:
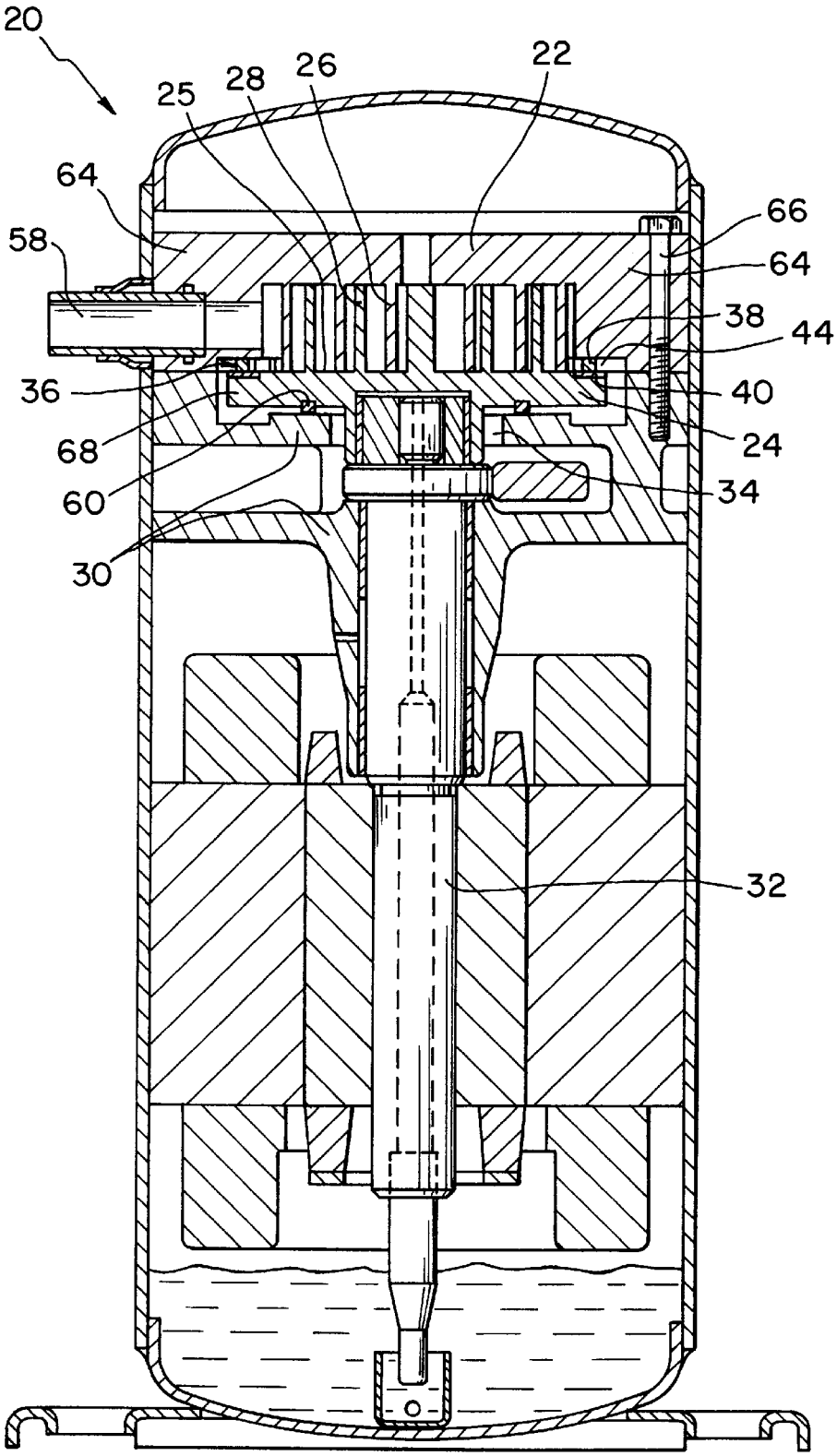
FIG. 1 is a cross sectional side view of a scroll compressor which embodies the present invention.

Corresponding reference characters indicate corresponding parts throughout the several views. The drawings, which represent embodiments of the present invention, are not necessarily to scale and certain features may be exaggerated. Although the exemplification set out herein illustrates embodiments of the invention in several forms, the embodiments disclosed below are not intended to be exhaustive or limit the invention to the precise forms disclosed in the following detailed description and are not to be construed as limiting the scope of the invention in any manner.

DESCRIPTION OF THE PRESENT INVENTION

Referring now to the drawings and particularly to FIG. 1, there is shown a scroll compressor 20. Scroll compressor 20 includes a fixed scroll 22 and an orbiting scroll 24. The fixed and orbiting scrolls 22, 24 each have a volute shaped scroll element, or wrap, 26 and 28 respectively. The scroll wraps 26, 28 interfit and are used to compress gases in a well known manner by orbiting the orbiting scroll 24 relative to the fixed scroll 22. Scroll compressors are well-known in the art and the disclosure of U.S. Pat. Nos. 5,131,828 and 5,383,772, assigned to the assignee of the present invention, provide disclosures of the structure and operation of scroll compressors which are expressly incorporated herein by reference.

The orbiting scroll 24 is eccentrically mounted on crankshaft 32 and anti-rotation means are used to prevent the orbiting scroll 24 from freely rotating about its own axis as it is orbited about the axis of the crankshaft 32. As the orbiting scroll is moved, a fluid is compressed between the two scrolls 22, 24 and creates a separating force which tends to axially separate the two scrolls 22, 24. The orbiting scroll 24 can be biased towards the fixed scroll 22 by a wide variety of different axial compliance mechanisms known in the art to overcome the axial separation force and bias the scrolls 22, 24 into mutual engagement.

The scroll compressor 20 illustrated in FIG. 1 has a main bearing member 30 supporting crankshaft 32. The orbiting scroll is disposed between the fixed scroll 22 and the main bearing member 30 and, in the illustrated embodiment, fluid at the discharge pressure is supplied to a high pressure region 34 near the center of the orbiting scroll between the orbiting scroll and the main bearing to bias the orbiting scroll towards the fixed scroll. Other axial compliance mechanisms may also be used with the present invention.

The fixed scroll member 22 includes an outer perimeter portion 64 which is secured to the main bearing with bolts 66. Outer perimeter portion 64 also includes lands 38 which convey thrust forces between the fixed and orbiting scroll. As can be seen in FIG. 1, outer perimeter portion 64 extends in an axial direction, i.e., in the direction defined by the axis of crankshaft 32, towards orbiting scroll 24 to an axial plane substantially parallel to, and disposed near, the axial plane defined by the scroll face 25 of the orbiting scroll. The axial planes are oriented substantially transverse to the crankshaft axis. Additional components of thrust bearing interface 36 are located on the outer perimeter portion 68 of the orbiting scroll 24 as described below.

Figure 2:
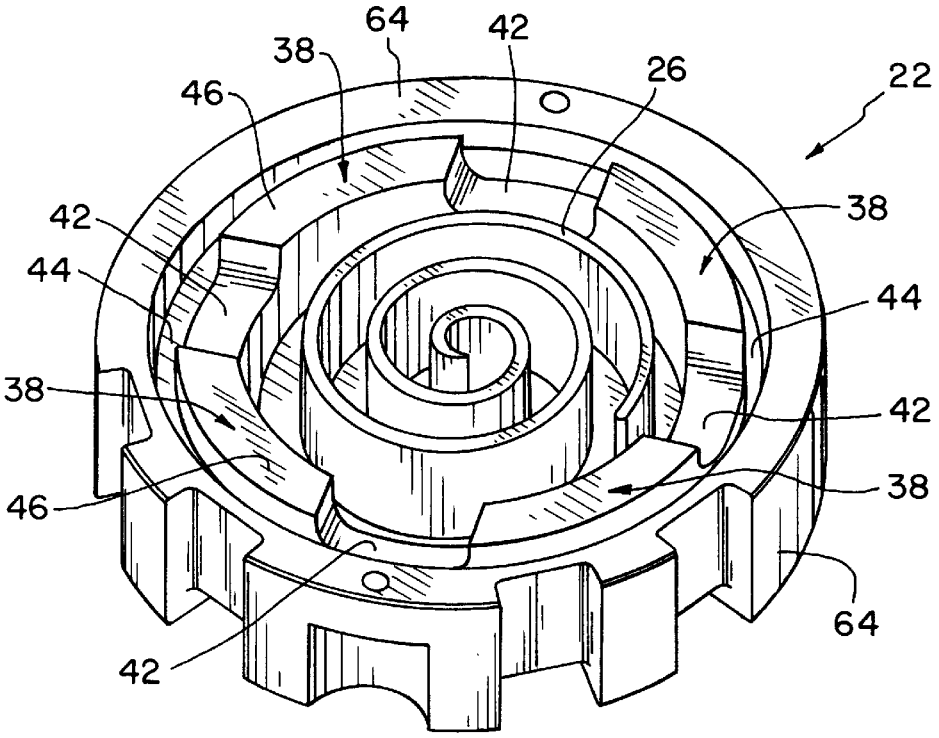
FIG. 2 is a perspective view of the fixed scroll member of FIG. 1.

The axial compliance force pushes orbiting scroll 24 against fixed scroll 22 and orbiting scroll 24 bears against fixed scroll 22 at thrust bearing interface 36 which is disposed radially outwardly of scroll wraps 26, 28. The force conveyed between the two scroll members 22, 24 by the thrust bearing interface 36 is the difference between the axial compliance force and the lesser axial separation force generated by the pressurized fluid between scroll members 22, 24. Thrust bearing interface 36, illustrated in FIG. 1, includes a plurality of non-contiguous lands 38 on the fixed scroll member 22 which bear against an annular overlay of wear resistant material 40 inset in the orbiting scroll 24. The fixed and orbiting scrolls illustrated in the embodiment of FIG. 1 are shown in greater detail in FIGS. 2 and 5 respectively. As can be seen in FIG. 2, voids 42 separate lands 38 and interconnect annular channel 44 with the working space of the compressor disposed radially inwardly of non-contiguous lands 38. Annular channel 44 is in communication with each of the voids 42 and voids 42 and annular channel 44 facilitate the lubrication of sliding surfaces 46 of lands 38 and of sliding surface 48 of wear resistant material 40 as orbiting scroll 24 is orbited by permitting oil to circulate freely and by repeatedly exposing portions of sliding surface 48 for lubrication as the orbiting scroll 24 is moved relative to fixed scroll 22.

A small amount of oil is present in the working fluid of the compressor which is compressed between the scroll wraps 26, 28 during operation of compressor 20. As the working fluid is introduced into the working space of the compressor via conduit 58 it conveys a mist of oil which is distributed in part to the thrust bearing interface 36 as well as to the wrap-tip interface and thereby provides oil for the lubrication of the thrust bearing interface 36. Lubricating oil may also be present in high pressure zone 34. Although annular seal 60 is orbited with the orbiting scroll to separate high pressure zone 34 from the lower pressure area surrounding high pressure zone 34, a small portion of lubricating oil is typically conveyed from high pressure zone 34 to the thrust bearing interface 36 located in the lower pressure area. As described in U.S. Pat. No. 5,131,828, a pool of oil may also be located beneath the orbiting scroll for stabilization of the orbiting scroll. A mist of oil is provided in voids 42 and annular channel 44 by one or more of the above mentioned sources and lubricates the sliding surfaces of the thrust bearing interface 36. The lubrication of the sliding surfaces reduces the frictional resistance encountered in movement of orbiting scroll 24, thereby reducing frictional power losses during operation of scroll compressor 20 and prolongs the useful life of the sliding surfaces.

The use of a non-contiguous thrust bearing interface for conveying all, or the majority of, the axial compliance forces conveyed between the fixed and orbiting scroll has additional advantages. For one, the location of thrust bearing interface 36 near the outer perimeter of orbiting scroll 24 also helps to counteract the overturning moment produced by operation of the scroll compressor. Another advantage is that the wrap tips of the scroll members do not bear axial compliance forces, or only a small portion thereof, and their life is thereby prolonged due to the reduced wear of the wrap tips. Controlling the dimensions of the thrust bearing interface elements can also maintain the wrap tips and faces of the scroll members in a fixed relationship, in combination with the axial compliance force, and thereby promote the efficient operation of the scroll compressor by facilitating the maintenance of a seal between the different compression pockets formed by the intermeshing scroll wraps 26, 28.

Figure 5:
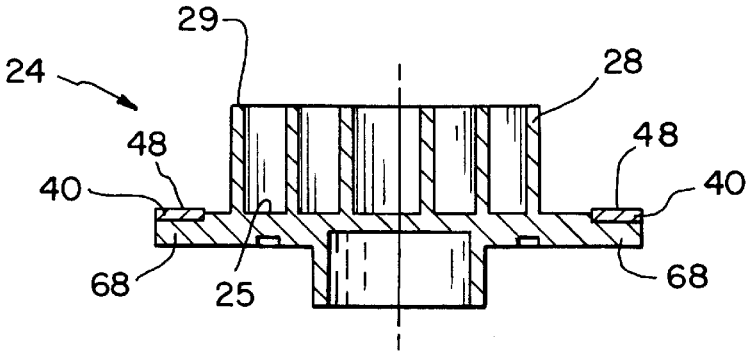
FIG. 5 is a sectional side view of the orbiting scroll member of FIG. 1.
Figure 6:
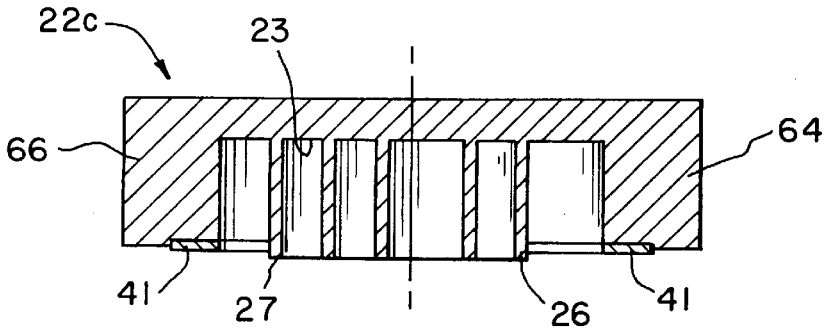
FIG. 6 is a sectional side view of an yet another fixed scroll member.

FIG. 5 illustrates the wrap tips 29 and scroll face 25 of an orbiting scroll member 24 while FIG. 6 illustrates the wrap tips 27 and scroll face 23 of a fixed scroll member 22*c*. A complicating factor in maintaining the sealing engagement of the wrap tips is the differential between the thermal expansion rates of the inner and outer portions of the wraps 26, 28. The internal portion of the scroll wraps experience more thermal expansion than the radially outer portion of the scroll wraps due to the differential amounts of heat created by compression of the working fluid in the different areas of the scroll members. The scroll wraps are, therefore, machined to have a slightly cupped shape to account for the differential thermal growth of the wrap tips as the two scroll members are maintained in an axially fixed relationship by the thrust bearing interface 36 and the axial compliance force.

Figure 3:
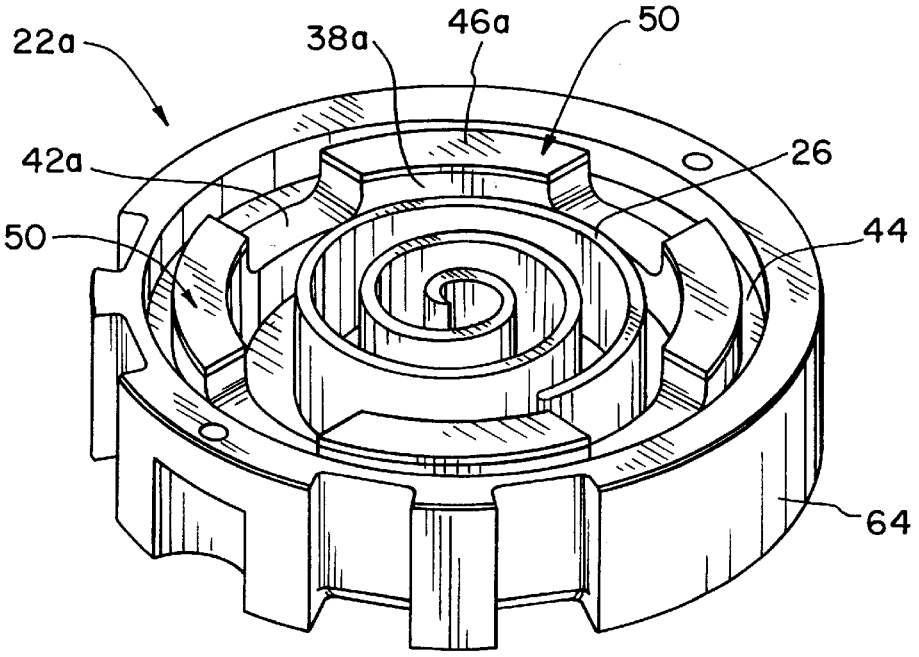
FIG. 3 is a perspective view of an alternative fixed scroll member.

Fixed scroll member 22*a* illustrated in FIG. 3 is similar to the scroll member 22 illustrated in FIG. 2 except for the use of wear resistant overlays 50 to form the sliding surfaces 46*a* of non-contiguous lands 38*a* which are separated by voids 42*a*. The wear resistant overlays 50 may be hard Swedish steel which has a lower coefficient of friction than the cast iron used for the scroll members and, thus, further reduces the frictional power losses of the compressor while enhancing the durability of the scroll compressor.

Figure 4:
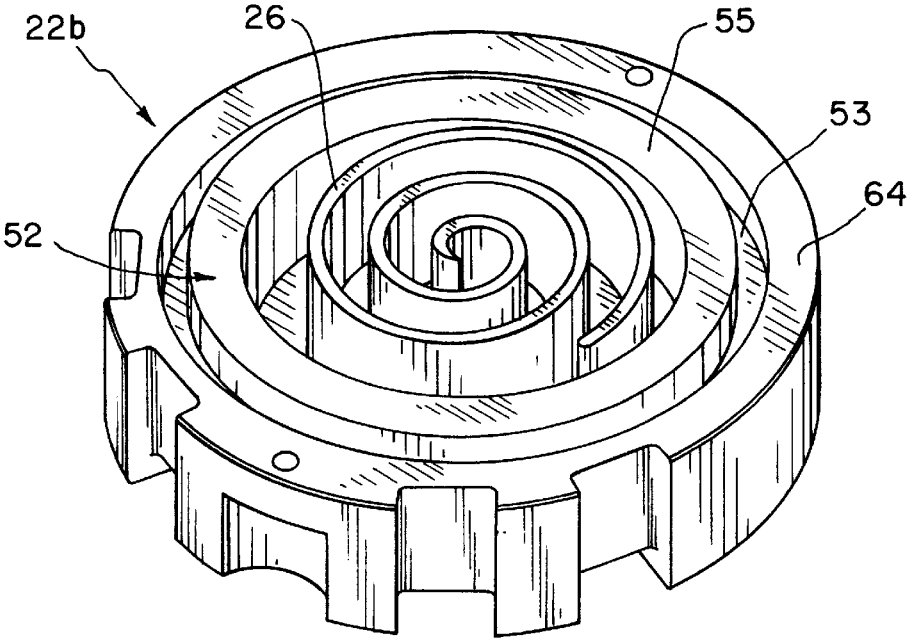
FIG. 4 is a perspective view of another fixed scroll member.

Alternative embodiments may reverse the location of the non-contiguous lands and utilize non-contiguous lands on the orbiting scroll (not shown) in combination with a fixed scroll member 22*b* shown in FIG. 4. Fixed scroll member 22*b* can also be used in combination with orbiting scroll 24 but without the benefits provided by the use of non-contiguous thrust bearing elements. Scroll member 22*b* has a continuous annular bearing member 52 providing annular sliding surface 55 which bears against the interfacing surfaces of the non-contiguous lands on the orbiting scroll. Fixed scroll member 22*b* is provided with annular recess 53 radially outside of and adjacent bearing member 52. The voids between the lands of the orbiting scroll member are interconnected through annular recess 53.

Another alternative fixed scroll member 22*c* for use with an orbiting scroll having non-contiguous lands is shown in FIG. 6. Scroll member 22*c* has a recess in which an annular overlay of wear resistant material 41 is disposed. Hardened, wear resistant material 41 slidingly bears against the non-contiguous lands on the orbiting scroll.

Figure 7:
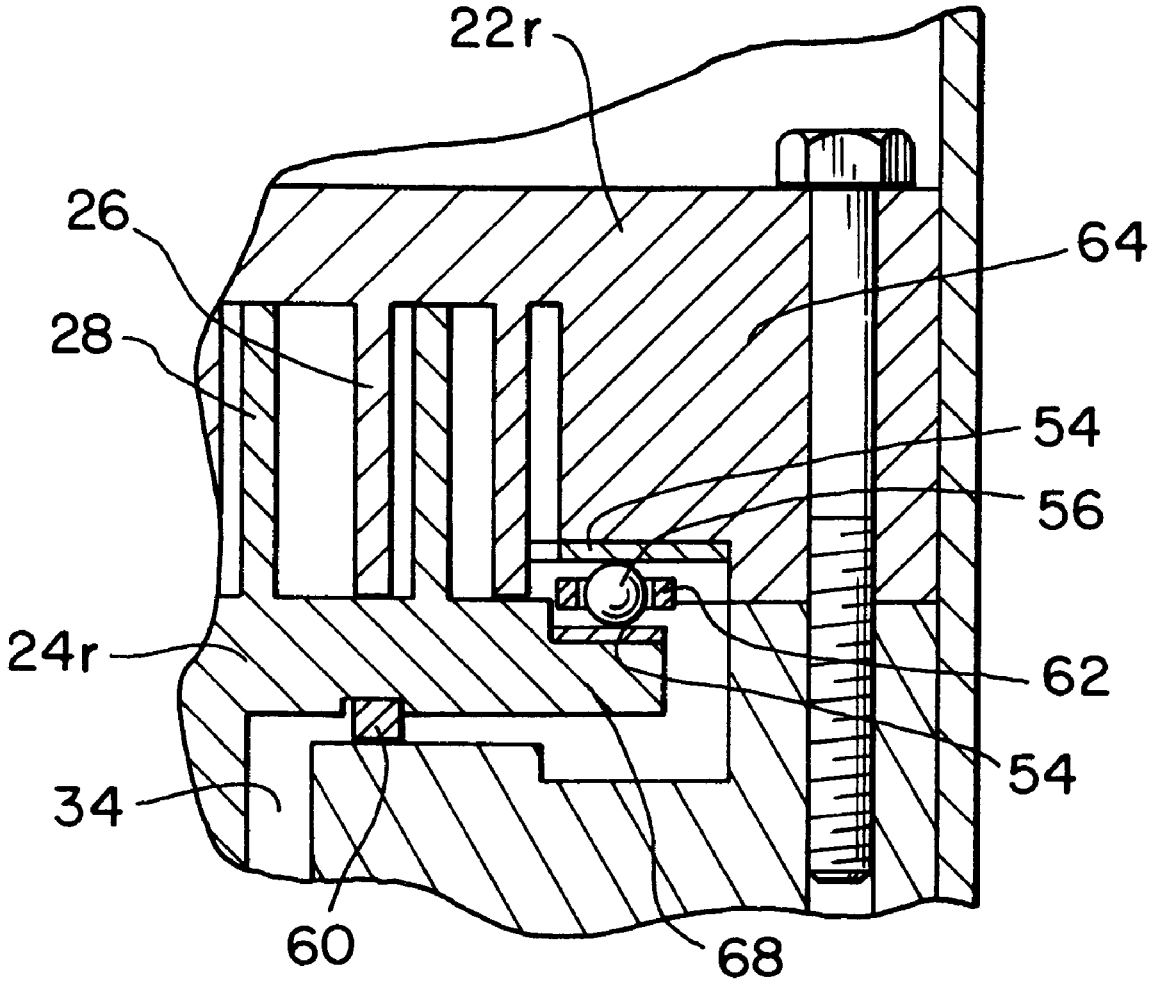
FIG. 7 is an enlarged fragmentary sectional side view of a thrust bearing interface having roller bearings.

It is also possible to replace the non-contiguous lands with roller bearings as shown in FIG. 7. In this embodiment, fixed scroll member 22*r* and orbiting scroll member 24*r* each have an annular recess in which hardened, annular wear resistant inlays 54 are disposed. Spaced roller bearings 56 bear against inlays 54 and transfer bearing forces between fixed and orbiting scrolls 22*r*, 24*r*. A retainer ring 62 is utilized to maintain the roller bearings in a spaced configuration. The spaced roller bearings 56 provide non-contiguous bearing elements having void spaces therebetween which facilitate the movement of oil and low pressure fluid therethrough in a manner similar to the discrete pads illustrated in FIGS. 2 and 3.

Instead of utilizing illustrated retainer 62, it is envisioned that the use of two retainer rings, one disposed in each of the recesses, having offset circular apertures permitting limited motion of roller bearings 56 within the apertures, could be used as an anti-rotation mechanism. It would also be possible to machine separate grooves or recesses in the face of the two scroll members for each roller bearing and thereby limit the travel of the roller bearings without the use of retainer rings to provide an anti-rotation mechanism. By disposing the roller bearings 56 between the fixed and orbiting scrolls 22*r*, 24*r* the present invention provides non-contiguous thrust bearing elements which transfer axial compliance forces between the fixed and orbiting scrolls 22*r*, 24*r* and the advantages concomitant therewith.

While this invention has been described as having an exemplary design, the present invention may be further modified within the spirit and scope of this disclosure. This application is, therefore, intended to cover any variations, uses, or adaptations of the invention using its general principles. Further, this application is intended to cover such departures from the present disclosure as come within known or customary practice in the art to which this invention pertains. Accordingly, the scope of the invention should be determined not by the illustrated embodiments but by the following claims and their legal equivalents.

What is claimed is:

1. A scroll compressor having a thrust bearing interface, said scroll compressor comprising:

a fixed scroll member having a fixed involute wrap element projecting from a first substantially planar surface, and a fixed outer perimeter portion disposed radially outwardly of said fixed involute wrap element;

an orbiting scroll member having an orbiting involute wrap element projecting from a second substantially planar surface, and an orbiting outer perimeter portion disposed radially outwardly of said orbiting involute wrap element, said fixed and orbiting scroll members adapted for mutual engagement with said fixed involute wrap element projecting towards said second surface and said orbiting involute wrap element projecting towards said first surface, said first surface positioned substantially parallel with said second surface whereby relative orbiting of said scroll members compresses fluids between said involute wrap elements;

an axial compliance mechanism, said fixed and orbiting scroll members biased into axial engagement by said axial compliance mechanism; and a plurality of non-contiguous thrust bearing elements circumferentially separated by voids, said plurality of non-contiguous thrust bearing elements comprising a plurality of arcuate pads projecting from one of said fixed and orbiting outer perimeter portions, said thrust bearing elements disposed between said fixed and orbiting outer perimeter portions and transmitting axial forces therebetween.

2. The scroll compressor of claim 1, wherein said pads bear against an annular bearing member disposed on the other of said fixed and orbiting outer perimeter portions.

3. The scroll compressor of claim 1, wherein said pads are integral with said one of said fixed and orbiting outer perimeter portions.

4. The scroll compressor of claim 3 wherein each of said pads further comprises a layer of wear resistant material forming a sliding surface on each of said pads.

5. The scroll compressor of claim 3 wherein said pads bear against an annular bearing member disposed on the other of said fixed and orbiting outer perimeter portions.

6. The scroll compressor of claim 1, wherein said plurality of pads project from said fixed outer perimeter portion and said fixed outer perimeter portion further comprises an annular recess radially outside the plurality of pads, said annular recess interconnecting each of said voids.

7. The scroll compressor of claim 6 wherein said pads bear against an annular bearing member disposed on said orbiting outer perimeter portion.

8. The scroll compressor of claim 6 wherein said annular recess and said voids provide fluid communication between a working space disposed axially between said fixed and orbiting scroll members and a second space disposed axially adjacent said orbiting scroll member opposite said working space.

9. A scroll compressor having a thrust bearing interface, said scroll compressor comprising:

a fixed scroll member having a fixed involute wrap element projecting from a first substantially planar surface, said fixed wrap element defining a spiral tip surface substantially parallel to said first planar surface and disposed in a first axial plane, and a fixed outer perimeter portion disposed radially outwardly of said fixed involute wrap element;

an orbiting scroll member having an orbiting involute wrap element projecting from a second substantially planar surface, and an orbiting outer perimeter portion disposed radially outwardly of said orbiting involute wrap element said fixed involute wrap element projecting towards said second surface and said orbiting involute wrap element projecting towards said first surface, said first surface positioned substantially parallel with said second surface, whereby relative orbiting of said scroll members compresses fluids between said involute wrap elements, one of said fixed and orbiting outer perimeter portions having a plurality of non-contiguous, arcuate thrust bearing elements having arcuate sliding surfaces, said thrust bearing elements separated by voids, said voids being interconnected by a recess located in the other of said fixed and orbiting outer perimeter portions, said recess located radially exterior to said thrust bearing elements, said arcuate sliding surfaces substantially parallel to said first planar surface;

a main bearing member attached to said fixed outer perimeter portion radially exterior to said recess;

a crankshaft supported by said main bearing member and operatively connected to said orbiting scroll member; and an axial compliance mechanism, said fixed and orbiting scroll members biased into axial engagement by said axial compliance mechanism.

10. The scroll compressor of claim 9 wherein each of said thrust bearing elements further comprises a layer of wear resistant material, said layers defining said arcuate sliding surfaces.

11. The scroll compressor of claim 9, wherein said other of said fixed and orbiting outer perimeter portions comprises a thrust bearing member defining an annular sliding surface which is in contact with said arcuate sliding surfaces, said annular sliding surface being disposed substantially parallel with said second planar surface and axially between said first and second planar surfaces.

* * * * *